United States Patent [19]

Polk et al.

[11] 4,052,201

[45] Oct. 4, 1977

[54] AMORPHOUS ALLOYS WITH IMPROVED RESISTANCE TO EMBRITTLEMENT UPON HEAT TREATMENT

[75] Inventors: Donald E. Polk, Boston, Mass.; Ranjan Ray; Lance A. Davis, both of Morristown, N.J.

[73] Assignee: Allied Chemical Corporation, Morris Township, N.J.

[21] Appl. No.: 590,656

[22] Filed: June 26, 1975

[51] Int. Cl.[2] ..... C22C 19/00; C22C 38/06; C22C 38/32

[52] U.S. Cl. ..... 75/124; 75/122; 75/134 F; 75/126 P; 75/170; 75/171

[58] Field of Search ..... 75/124, 122, 134 F, 75/170, 171, 126 P, 128 F

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 75/122 |
| 3,986,867 | 10/1976 | Masumoto et al. | 75/126 A |

*Primary Examiner*—Arthur J. Steiner

*Attorney, Agent, or Firm*—David W. Collins; Arthur J. Plantamura

[57] ABSTRACT

An improvement in resistance to embrittlement upon heat treatment of amorphous metal alloys containing iron, nickel, cobalt and/or chromium in the temperature range of about 200° to 350° C is achieved by including boron or boron plus at least one metalloid element of carbon, silicon and aluminum in a total amount of about 15 to 25 atom percent of the alloy composition.

5 Claims, No Drawings

AMORPHOUS ALLOYS WITH IMPROVED RESISTANCE TO EMBRITTLEMENT UPON HEAT TREATMENT

BACKGROUND OF THE INVENTION

1. Field of the Invention

The invention relates to amorphous metal alloy compositions, and, in particular, to amorphous alloys containing iron, nickel, cobalt and/or chromium having improved resistance to embrittlement upon heat treatment.

2. Description of the Prior Art

Investigations have demonstrated that it is possible to obtain solid amorphous metals for certain alloy compositions. An amorphous substance generally characterizes a non-crystalline or glassy substance, that is, a substance substantially lacking any long range order. In distinguishing an amorphous substance from a crystalline substance, X-ray diffraction measurements are generally suitably employed. Additionally, transmission electron micrography and electron diffraction can be used to distinguish between the amorphous and the crystalline state.

An amorphous metal produces an X-ray diffraction profile in which intensity varies slowly with diffraction angle. Such a profile is qualitatively similar to the diffraction profile of a liquid or ordinary window glass. On the other hand, a crystalline metal produces a diffraction profile in which intensity varies rapidly with diffraction angle.

These amorphous metals exist in a metastable state. Upon heating to a sufficiently high temperature, they crystallize with evolution of a heat of crystallization, and the X-ray diffraction profile changes from one having glassy or amorphous characteristics to one having crystalline characteristics.

It is possible to produce a metal which is totally amorphous or which comprises a two-phase mixture of the amorphous and crystalline state. The term "amorphous metal", as employed herein, refers to a metal which is at least 50% amorphous, and preferably 80% amorphous, but which may have some fraction of the material present as included crystallites.

Proper processing will produce a metal alloy in the amorphous state. One typical procedure is to cause molten alloy to be spread thinly in contact with a solid metal substrate such as copper or aluminum so that the molten alloy loses its heat to the substrate. When the molten alloy is spread to a thickness at about 0.002 inch, cooling rates of the order of $10^6$° C/sec are achieved. See, for example, R. C. Ruhl, Vol. 1, *Materials Science and Engineering*, pp. 313–319 (1967), which discusses the dependence of cooling rates upon the conditions of processing the molten alloys. Any process which provides a suitable high cooling rate, as on the order of $10^5$° to $10^6$° C/sec, can be used. Illustrative examples of procedures which can be used to make the amorphous metals are the rotating double roll procedure described by H. S. Chen and C. E. Miller in Vol. 41, *Review of Scientific Instruments*, pp. 1237–1238 (1970) and the rotating cylinder technique described by R. Pond, Jr. and R. Maddin in Vol. 245, *Transactions of the Metallurgical Society, AIME*, pp. 2475–2476 (1969).

Novel amorphous metal alloys have been disclosed and claimed by H. S. Chen and D. E. Polk in U.S. Pat. No. 3,856,513, issued Dec. 24, 1974. These amorphous alloys have the formula $M_aY_bZ_c$, where *M* is at least one metal selected from the group consisting of iron, nickel, cobalt, chromium and vanadium, *Y* is at least one element selected from the group consisting of phosphorus, boron and carbon, *Z* is at least one element selected from the group consisting of aluminum, antimony, beryllium, germanium, indium, tin and silicon, *a* ranges from about 60 to 90 atom percent, *b* ranges from about 10 to 30 atom percent and *c* ranges from about 0.1 to 15 atom percent. These alloys have been found suitable for a wide variety of applications, including ribbon, sheet, wire, powder, etc. Amorphous alloys are also disclosed and claimed having the formula $T_iX_j$, where T is at least one transition metal, X is at least one element selected from the group consisting of aluminum, antimony, beryllium, boron, germanium, carbon, indium, phosphorus, silicon and tin, *i* ranges from about 70 to 87 atom percent and *j* ranges from about 13 to 30 atom percent. These alloys have been found suitable for wire applications.

Ductility is generally desirable either to render mechanical applictions possible or to ease the handling and processing of the product. It is known that amorphous metal alloys tend to lose ductility in bending upon heating to temperatures near which the onset of crystallization occurs (crystallization temperature). Often, prolonged heating at lower temperatures is sufficient to induce embrittlement. Many of the amorphous alloys containing iron, nickel, cobalt and/or chromium known in the art, which include phosphorus as an aid to glass formation tend to embrittle upon heating in the temperature range of about 200° to 350° C. While many applications involving these amorphous alloys would not require such heat treatment, there are specific instances where such heating would be necessary and where it would be desirable to utilize these alloys, many of which are relatively inexpensive compositions.

SUMMARY OF THE INVENTION

In accordance with the invention, an improvement in resistance to embrittlement upon heat treatment of amorphous metal alloys consisting essentially of at least one element selected from the group consisting of iron, nickel, cobalt and chromium in the temperature range of about 200° to 350° C is achieved by including boron plus at least one metalloid element selected from the group consisting of carbon, silicon and aluminum in a total amount of about 15 to 25 atom percent of the alloy composition. The amorphous metal alloys of this invention consist essentially of the composition $M_aX_b$, where M is at least one element of iron, nickel, cobalt and chromium, X is boron plus at least one element of carbon, silicon and aluminum, *a* ranges from about 75 to 85 atom percent and *b* ranges from about 15 to 25 atom percent. Preferably, X is about 60 to 80 percent boron, and *b* ranges from about 17 to 22 atom percent. These alloy compositions may include up to about 20 atom percent, as in the order of about 5 to 15 atom percent, of chromium, and up to about 30 atom percent, as in the order of about 15 to 25 atom percent, of cobalt.

Also in accordance with the invention, an improvement in resistance to embrittlement upon heat treatment is also obtained for alloys which consist essentially of the composition $M'_aB_b$, where M' is at least three elements selected from the group consisting of iron, nickel, cobalt and chromium, the amount of each of iron, nickel and cobalt ranging from about 20 to 35 atom percent, and preferably from about 20 to 30 atom percent, and the amount of chromium ranging from about 5 to 20 atom percent, and preferably from about 5 to 15 atom percent, and where *a* ranges from about 75 to 85 atom percent and *b* ranges from about 15 to 25 atom percent. Preferably, *b* ranges from about 17 to 22 atom percent.

The alloys in accordance with the invention do not become brittle to bending upon heating to temperatures typically employed in subsequent processing. These alloys are also characterized by increased mechanical strength.

The amorphous metal alloys in accordance with the invention are fabricated by a process which comprises forming a melt of the desired composition and quenching at a rate of about $10^{5°}$ to $10^{6°}$ C/sec by casting molten alloy onto a chill wheel or into a quench fluid. Improved physical and mechanical properties, together with a greater degree of amorphousness, are achieved by casting the molten alloy onto a chill wheel in a partial vacuum having an absolute pressure of less than about 5.5 cm of Hg.

DETAILED DESCRIPTION OF THE INVENTION

The thermal stability of an amorphous metal alloy is an important property in certain applications. Thermal stability is characterized by the time-temperature transformation behavior of an alloy, and may be determined in part by DTA (differential thermal analysis). As considered here, relative thermal stability is also indicated by the retention of ductility in bending after thermal treatment. Amorphous metal alloys with similar crystallization behavior as observed by DTA may exhibit different embrittlement behavior upon exposure to the same heat treatment cycle. By DTA measurement, crystallization temperatures, $T_c$, can be accurately determined by slowly heating an amorphous metal alloy (at about 20° to 50° C/min) and nothing whether excess heat is evolved over a limited temperature range (crystallization temperature) or whether excess heat is absorbed over a particular temperature range (glass transition temperature). In general, the glass transition temperature $T_g$ is near the lowest, or first, crystallization temperature, $T_{cl}$, and, as is conventional, is the temperature at which the viscosity ranges from about $10^{13}$ to $10^{14}$ poise.

Most amorphous metal alloy compositions containing iron, nickel, cobalt and/or chromium which include phosphorus, among other metalloids, evidence ultimate tensile strengths of about 265,000 to 350,000 psi and crystallization temperatures of about 400° to 460° C. For example, an amorphous metal alloy having the composition $Fe_{76}P_{16}C_4Si_2Al_2$ (the subscripts are in atom percent) has an ultimate tensile strength of about 310,000 psi and a crystallization temperature of about 460° C; an amorphous metal alloy having the composition $Fe_{30}Ni_{30}Co_{20}P_{13}B_5Si_2$ has an ultimate tensile strength of about 265,000 psi and a crystallization temperature of about 415° C; and an amorphous metal alloy having the composition $Fe_{74.3}Cr_{4.5}P_{15.9}C_5B_{0.3}$ has an ultimate tensile strength of about 350,000 psi and a crystallization temperature of 446° C. The thermal stability of these compositions in the temperature range of about 200° to 350° C is low, as evidenced by a tendency to embrittle after heat treating, for example, at 330° C for 5 minutes. Such heat treatment is required in certain specific applications, such as curing a coating of polytetrafluoroethylene on razor blade edges.

In accordance with the present invention, the resistance to embrittlement upon heat treatment of these alloys in the temperature range of about 200° to 350° C for several minutes is improved by replacing phosphorus with boron or boron plus at least one of the metalloid elements of carbon, silicon and aluminum.

Specifically, the amorphous metal alloys of the invention consist essentially of the composition $M_aX_b$, where M is at least one element of iron, nickel, cobalt and chromium, X is boron plus at least one element of carbon, silicon and aluminium, *a* ranges from about 75 to 85 atom percent and *b* ranges from about 15 to 25 atom percent. Examples include $Fe_{77}B_{15}C_5Si_1Al_2$, $Fe_{60}Cr_{18}B_{15}C_5Si_2$ and $Fe_{28}Ni_{28}Co_{20}B_{18}C_2Si_2Al_2$.

For these amorphous metal alloys, ease of glass formation occurs where *b* ranges from about 17 to 22 atom percent. Optimum thermal stability is achieved with compositions where about 60 to 80 percent of X is boron. Accordingly, such compositions are preferred.

The properties of corrosion resistance, hardness, and mechanical strength are improved in these amorphous metal alloys by including up to about 20 atom percent of chromium in the total alloy composition. Preferably, chromium is present in an amount of about 5 to 15 atom percent of the total alloy composition for optimum improvement.

Glass formation is aided in these amorphous metal alloys by including up to about 30 atom percent of cobalt. Preferably, cobalt is present in an amount of about 15 to 25 atom percent of the total alloy composition for optimum ease of glass formation.

The amorphous metal alloys of the invention also consist essentially of the composition $M'_aB_b$, where M' is at least three elements selected from the group consisting of iron, nickel, cobalt and chromium, the amount of each of iron, nickel and cobalt ranging from about 20 to 35 atom percent, and preferably from about 20 to 30 atom percent, and the amount of chromium ranging from about 5 to 20 atom percent, and preferably from about 5 to 15 atom percent, and where *a* ranges from about 75 to 85 atom percent and *b* ranges from about 15 to 25 atom percent. Preferably, *b* ranges from about 17 to 22 atom percent. Examples include $Fe_{30}Ni_{30}Co_{20}B_{20}$, $Fe_{30}Ni_{30}Co_{23}B_{17}$, $Fe_{30}Ni_{32}Cr_{20}B_{18}$ and $Fe_{25}Ni_{25}Co_{20}Cr_{10}B_{20}$.

Such amorphous metal alloys containing boron evidence superior strength over compositions which include phosphorus. For example, an amorphous metal alloy having the composition $Fe_{25}Ni_{25}Co_{20}Cr_{10}B_8P_{12}$ has an ultimate tensile strength of 330,000 psi. Changing the metalloid content to $-B_{16}P_4$ increases the ultimate tensile strength to 395,000 psi. Where the metalloid content is $-B_{20}$, the ultimate tensile strength is increased to 500,000 psi. The crystallization temperature is also observed to increase from 461° C for $Fe_{25}Ni_{25}Co_{20}Cr_{10}B_8P_{12}$ to 485° C for $Fe_{25}Ni_{25}Co_{20}Cr_{10}B_{20}$. These amorphous metal alloys in which boron is the only metalloid element are also characterized by high hardness values, which are typically about 1000 DPH.

The amorphous metal alloys are formed by cooling a melt at a rate of about $10^{5°}$ to $10^{6°}$ C/sec. A variety of techniques are available, as is now well-known in the art, for fabricating splat-quenched foils and rapid-quenched continuous ribbons, wire, sheet, etc. Typically, a particular composition is selected, powders of the requisite elements (or of materials that decompose to form the elements, such as ferroboron, ferrosilicon, etc.) in the desired proportions are melted and homogenized, and the molten alloy is rapidly quenched either on a chill surface, such as a rotating cylinder, or in a suitable fluid medium, such as a chilled brine solution. The amorphous metal alloys may be formed in air. However, superior physical and mechanical properties are achieved by forming these amorphous metal alloys in a partial vacuum with absolute pressure less than about 5.5 cm of Hg, and preferably about 100 μm to 1 cm of Hg, as disclosed in a patent application of R. Ray et al., Ser. No. 552.673, filed Feb. 24, 1975. The purity of all materials is that found in normal commercial practice.

While as stated earlier the amorphous metal alloys are at least 50% amorphous, and preferably at least 80% amorphous, a substantial degree of amorphousness approaching 100% amorphous is obtained by forming these amorphous metal alloys in a partial vacuum. Ductility is thereby improved, and such alloys possessing a substantial degree of amorphousness are accordingly preferred.

The amorphous metal alloys of the invention evidence superior fabricability, compared with prior art alloys. In addition to their improved resistance to embrittlement upon heat treatment, the amorphous metal alloys of the present invention tend to be more oxidation and corrosion resistant than prior art compositions.

These alloy compositions remain amorphous at heat treating conditions under which phosphorus-containing amorphous alloys tend to embrittle. Ribbons of these alloys find use in applications requiring relatively higher thermal stability and increased mechanical strength.

EXAMPLES

Rapid melting and fabrication of amorphous strips of ribbons of uniform width and thickness from high melting (about 1100° to 1600° C) reactive alloys was accomplished under vacuum. The application of vacuum minimized oxidation and contamination of the alloy during melting or squirting and also eliminated surface damage (blisters, bubbles, etc.) commonly observed in strips processed in air or inert gas at 1 atm. A copper cylinder was mounted vertically on the shaft of a vacuum rotary feedthrough and placed in a stainless steel vacuum chamber. The vacuum chamber was a cylinder flanged at two ends with two side ports and was connected to a diffusion pumping system. The copper cylinder was rotated by variable speed electric motor via the feedthrough. A crucible surrounded by an induction coil assembly was located above the rotating cylinder inside the chamber. An induction power supply was used to melt alloys contained in crucibles made of fused quartz, boron nitride, alumina, zirconia or beryllia. The amorphous ribbons were prepared by melting the alloy in a suitable nonreacting crucible and ejecting the melt by overpressure of argon through an orifice in the bottom of the crucible onto the surface of the rotating (about 1500 to 2000 rpm) cylinder. The melting and squirting were carried out in a partial vacuum of about 100 μ m, using an inert gas such as argon to adjust the vacuum pressure. The amorphous ribbons were subsequently tested for ultimate tensile strength.

Using the vacuum-melt casting apparatus described above, a number of various glass-forming metal alloys were chill cast as continuous ribbons having substantially uniform thickness and width. Typically, the thickness ranged from 0.001 to 0.003 inch and the width ranged from 0.05 to 0.12 inch.

The mechanical behavior as a function of heat treatment conditions of amorphous metal alloys having compositions in accordance with the invention was compared with that of phosphorus-containing amorphous metal alloys. All alloys were fabricated by the process given above. The amorphous ribbons of the alloys of this invention were all ductile in the as-quenched condition, and remained so upon heat treatment within the range of about 200° to 350° C for several minutes. This was in contrast with ribbons of amorphous alloys which included phosphorus as a metalloid element. These alloys evidenced embrittlement under the same conditions of heat treatment. The ductility of the ribbons in the as-quenched and heat treated conditions was determined as follows. The ribbons were bent end on end to form a loop. The diameter of the loop was gradually reduced between the anvils of a micrometer. The ribbons were considered ductile if they could be bent to a radius of curvature less than about 0.005 inch without fracture. If a ribbon fractured, it was considered to be brittle. Table I lists the results of these tests.

TABLE I

Ductility Of Certain Amorphous Metal Alloys As A Function Of Heat Treatment

| Alloy Composition (Atom Percent) | Heat Treatment 200° C, 90 min | 250° C, 90 min | 325° C, 5 min | 350° C, 10 min |
|---|---|---|---|---|
| $Fe_{28}Ni_{30}Co_{20}B_{18}C_2Al_2$ | ductile | ductile | ductile | brittle |
| $Fe_{29}Ni_{49}P_{14}B_6Si_2$* | brittle | brittle | brittle | brittle |
| | Time at Temperature of Heat Treatment of 255° to 260° C | | | |
| | 10 min | 30 min | 60 min | |
| $Fe_{30}Ni_{30}Co_{20}B_{18}Si_2$ | ductile | ductile | ductile | |
| $Fe_{30}Ni_{30}Co_{20}P_{13}B_5Si_2$* | brittle | brittle | brittle | |
| | Temperature of Heat Treatment For Time of 30 Min | | | |
| | 225° C | 255° C | 270° C | 290° C |
| $Fe_{30}Ni_{30}Co_{20}B_{18}Si_2$ | ductile | ductile | ductile | ductile |
| $Fe_{30}Ni_{30}Co_{20}P_{13}B_5Si_2$* | brittle | brittle | brittle | brittle |

*Prior art compositions

The data on mechanical and thermal properties (ultimate tensile strength in psi; crystallization temperature in °C) of some typical amorphous metal alloys in accordance with the invention are given in Table II below.

TABLE II

Mechanical and Thermal Properties of Amorphous Metal Alloys

| Alloy Composition (Atom Percent) | Ultimate Tensile Strength (psi) | Crystallization Temp. (° C)* |
|---|---|---|
| $Fe_{77}B_{15}C_5Si_1Al_2$ | 486,000 | 510 |
| $Fe_{66}Cr_{12}B_{15}C_5Si_2$ | 434,000 | 550 |
| $Fe_{60}Cr_{18}B_{15}C_5Si_2$ | 438,000 | 578 |
| $Fe_{30}Ni_{30}Co_{20}B_{18}Si_2$ | 403,000 | 478 |
| $Fe_{28}Ni_{30}Co_{20}B_{16}Si_4Al_2$ | 338,000 | 479 |
| $Fe_{28}Ni_{28}Co_{20}B_{18}C_2Si_2Al_2$ | 320,000 | 490 |
| $Fe_{28}Ni_{30}Co_{20}B_{18}C_2Al_2$ | 280,000 | 457 |
| $Fe_{30}Ni_{30}Co_{20}B_{17}Al_3$ | 335,000 | 442 |
| $Fe_{25}Ni_{25}Co_{20}Cr_{10}B_{20}$ | 500,000 | 485 |
| $Fe_{30}Ni_{30}Co_{23}B_{17}$ | 403,000 | 443, 447 |

*Heating rate: 29° C/min

What is claimed is:

1. An amorphous metal alloy that is at least 50 percent amorphous, characterized in that the alloy consists essentially of one of the compositions selected from the group consisting of $Fe_{77}B_{15}C_5Si_1Al_2$, $Fe_{66}Cr_{12}B_{15}C_5Si_2$, $Fe_{60}Cr_{18}B_{15}C_5Si_2$, $Fe_{30}Ni_{30}Co_{20}B_{18}Si_2$, $Fe_{28}Ni_{30}Co_{20}B_{16}Si_4Al_2$, $Fe_{28}Ni_{28}Co_{20}B_{18}C_2Si_2Al_2$, $Fe_{28}Ni_{30}Co_{20}B_{18}C_2Al_2$ and $Fe_{30}Ni_{30}Co_{20}B_{17}Al_3$, said alloy being resistant to embrittlement upon heat treatment in the temperature range of about 200° to 325° C for at least 5 minutes.

2. An amorphous metal alloy that is at least 50% amorphous, characterized in that the alloy consists essentially of the composition $M'_aB_b$, where M' is at least three elements selected from the group consisting of iron, nickel, cobalt and chromium, the amount of each of iron, nickel and cobalt ranging from about 20 to 35 atom percent and the amount of chromium ranging from about 5 to 20 atom percent and B is boron and where *a* ranges from about 75 to 85 atom percent and *b* ranges from about 15 to 25 atom percent, said alloy being resistant to embrittlement upon heat treatment in the temperature range of about 200° to 325° C for at least 5 minutes.

3. The amorphous metal alloy of claim 2 in which the amount of each of iron, nickel and cobalt ranges from about 20 to 30 atom percent and the amount of chromium ranges from about 5 to 15 atom percent.

4. The amorphous metal alloy of claim 2 in which *b* ranges from about 17 to 22 atom percent.

5. The amorphous metal alloy of claim 2 consisting essentially of a composition selected from the group consisting of $Fe_{30}Ni_{30}Co_{20}B_{20}$, $Fe_{30}Ni_{30}Co_{23}B_{17}$, $Fe_{30}Ni_{32}Cr_{20}B_{18}$ and $Fe_{25}Ni_{25}Co_{20}Cr_{10}B_{20}$.

* * * * *